US007266963B2

(12) United States Patent
Lee

(10) Patent No.: US 7,266,963 B2
(45) Date of Patent: Sep. 11, 2007

(54) SWITCHING DEVICE FOR REFRIGERATOR

(75) Inventor: Soo-Beom Lee, Changwon (KR)

(73) Assignee: LG Electronics Inc., Seoul (KR)

( * ) Notice: Subject to any disclaimer, the term of this patent is extended or adjusted under 35 U.S.C. 154(b) by 325 days.

(21) Appl. No.: 11/024,703

(22) Filed: Dec. 30, 2004

(65) Prior Publication Data

US 2005/0138948 A1 Jun. 30, 2005

(30) Foreign Application Priority Data

Dec. 31, 2003 (KR) ..... 10-2003-0101598

(51) Int. Cl.
*F25D 23/12* (2006.01)

(52) U.S. Cl. ..... 62/259.1; 62/163; 62/331; 49/67

(58) Field of Classification Search ..... 62/259.1, 62/331, 161–163; 49/70, 167, 381; 340/3.9
See application file for complete search history.

(56) References Cited

U.S. PATENT DOCUMENTS

| | | | | |
|---|---|---|---|---|
| 2,942,438 | A * | 6/1960 | Schmeling | 62/377 |
| 3,103,420 | A * | 9/1963 | Epstein | 34/58 |
| 3,254,503 | A * | 6/1966 | Rundell | 62/275 |
| 3,429,140 | A * | 2/1969 | White | 62/339 |
| 3,857,625 | A * | 12/1974 | Crane et al. | 439/31 |
| 4,151,681 | A * | 5/1979 | Roberts | 49/382 |
| 5,212,907 | A * | 5/1993 | Van Sandt | 49/70 |
| 5,727,960 | A * | 3/1998 | Zehrung | 439/165 |
| 5,787,724 | A * | 8/1998 | Pohl et al. | 62/389 |
| 5,941,619 | A * | 8/1999 | Stieben et al. | 312/223.6 |
| 6,055,823 | A * | 5/2000 | Baker et al. | 62/265 |
| 6,192,630 | B1 | 2/2001 | Banicevic et al. | |
| 6,679,006 | B2 * | 1/2004 | Banicevic et al. | 49/501 |
| 2002/0002758 | A1 * | 1/2002 | Stura et al. | 16/287 |

FOREIGN PATENT DOCUMENTS

| | | | |
|---|---|---|---|
| DE | 3319757 | | 3/1984 |
| DE | 10061747 | | 10/2001 |
| JP | 05-045049 | | 2/1993 |
| JP | 05-060455 | | 3/1993 |
| JP | 2000-18812 | A * | 1/2000 |
| JP | 2000-142269 | | 5/2000 |
| JP | 2001-280815 | | 10/2001 |
| KR | 1020020034388 | A | 5/2002 |

* cited by examiner

*Primary Examiner*—Mohammad M. Ali
(74) *Attorney, Agent, or Firm*—Ked & Associates, LLP

(57) ABSTRACT

A switching device for an integrated product, such as a display, installed on a front surface of a door of a refrigerator is provided. The switching device includes a hinge assembly which rotatably couples the door to the refrigerator. The hinge assembly includes a power switch that applies power to the display, and a connector that connects the display to an external signaling/communication source. The switch may be provided on a lateral surface of a hinge plate portion of the assembly, and the connector may be provided on a rear surface of the hinge plate. The power switch and the connector may be connected to the display by lead wires.

15 Claims, 3 Drawing Sheets

SWITCHING DEVICE FOR REFRIGERATOR

BACKGROUND OF THE INVENTION

1. Field of Invention

The present invention relates to a refrigerator, and more particularly, to a switching device for controlling the supply of power to additional products installed in the refrigerator.

2. Description of the Prior Art

As shown in FIG. 1 in which an external appearance of a general refrigerator is depicted, a storage space which is partitioned into a freezing chamber and a refrigerating chamber is provided in a main body 1 of the refrigerator, and a freezing chamber door 3 and a refrigerating chamber door 5 are pivotally installed at both sides of the main body of the refrigerator, respectively. The freezing chamber door 3 and refrigerating chamber door 5 serve to open and close the freezing and refrigerating chambers defined within the main body 1 of the refrigerator, respectively. Further, the doors 3 and 5 are installed such that they can be pivoted, respectively, by hinge assemblies 13 and 15 provided on a top surface of the main body 1 of the refrigerator.

To enhance a user's convenience and prevent cold air from unnecessarily leaking out, a dispenser 7 is installed at a portion on a front surface of the freezing chamber door 3. The dispenser 7 is installed such that water or ice stored in the refrigerator can be dispensed out without opening the freezing chamber door 3.

Further, an additional product integrated with the refrigerator (hereinafter, referred to as an integrated product) is provided at a portion on a front surface of the refrigerating chamber door 5. As an example of the integrated product, a display unit 9 is shown in FIG. 1. The display unit 9 can provide a function of representing a variety of information on the operation of the refrigerator, a TV receiving function and an Internet function.

A control unit 11 in which circuit components are installed to control the operations of the refrigerator and display unit 9 is provided on the top surface of the main body 1 of the refrigerator. The control unit 11 also performs the control of the display unit 9 as well as the refrigerator by means of the electrical components installed within the control unit 11.

Recently, a tablet computer or display unit is also used as such an integrated product installed to the refrigerator. At this time, each of the additional integrated products should have an additional power switch and be connected to a LAN for operating a computer or to an antenna for watching TV. However, if either the power switch or the connecting portion to the LAN or antenna is provided on a front surface of the integrated product, the external appearance of the refrigerator is not clean.

SUMMARY OF THE INVENTION

Accordingly, the present invention is conceived to solve the aforementioned problem in the prior art. An object of the present invention is to provide a switching device for a refrigerator by which a front appearance of the refrigerator can be simplified.

According to the present invention for achieving the object, there is provided a switching device for a refrigerator including a main body of the refrigerator with a storage space defined therein, a door for opening and closing the storage space and the integrated product installed to the door, comprising: a hinge assembly for pivotally connecting the door to the main body; a power switch installed to a side of the hinge assembly for applying power to the integrated product for the refrigerator; and a connector installed to another side of the hinge assembly for transmitting external electrical signals to the integrated product.

The power switch is installed to a lateral surface of the hinge assembly, and the connector is installed to a rear surface of the hinge assembly.

The integrated product is a display unit, and the connector is connected to an antenna.

A lead wire (W1) for connecting the power switch and the integrated product and a lead wire (W2) for connecting the connector and the integrated product pass through a through-hole formed in a hinge pin of the hinge assembly.

According to another aspect of the present invention for achieving the object, there is provided a switching device for a refrigerator including a main body of the refrigerator with a storage space defined therein, a door for opening and closing the storage space and the integrated product installed to the door, comprising: a hinge assembly for pivotally connecting the door and the main body with respect to each other; and a power switch installed to a lateral or rear surface of the hinge assembly for applying power to the integrated product for the refrigerator installed to the door.

According to another aspect of the present invention for achieving the object, there is provided a switching device for a refrigerator including a main body of the refrigerator with a storage space defined therein, a door for opening and closing the storage space and the integrated product installed to the door, comprising: a hinge assembly for pivotally connecting the door and the main body with respect to each other; and a connector installed to a lateral or rear surface of the hinge assembly for transmitting external electrical signals to the integrated product for the refrigerator installed to the door.

BRIEF DESCRIPTION OF THE DRAWINGS

The above and other objectives, features and advantages of the present invention will become apparent from the following description of a preferred embodiment given in conjunction with the accompanying drawings, in which.

DETAILED DESCRIPTION OF THE PREFERRED EMBODIMENT

Hereinafter, a preferred embodiment of a switching device for a refrigerator according to the present invention will be described in detail with reference to the accompanying drawings.

Figure 1:
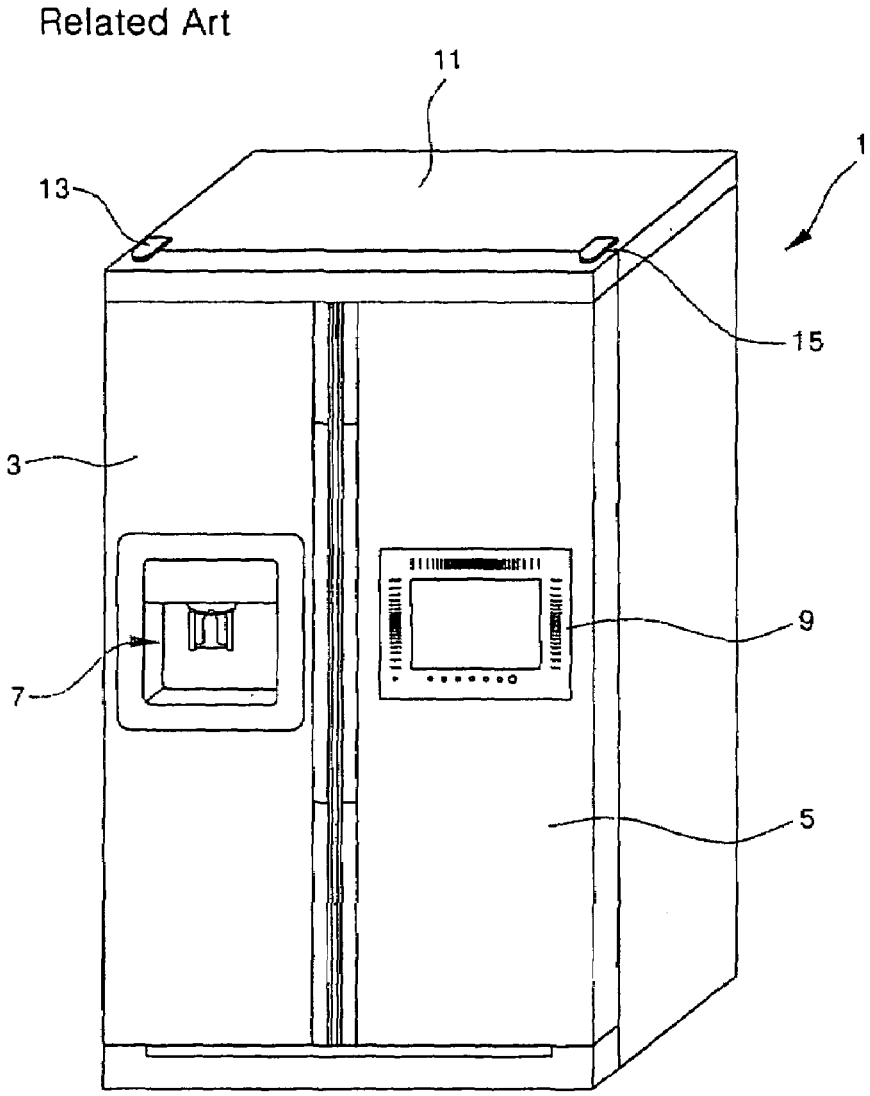
FIG. 1 is a perspective view showing an external appearance of a refrigerator with an additional product integrated therewith according to the prior art.
Figure 2:
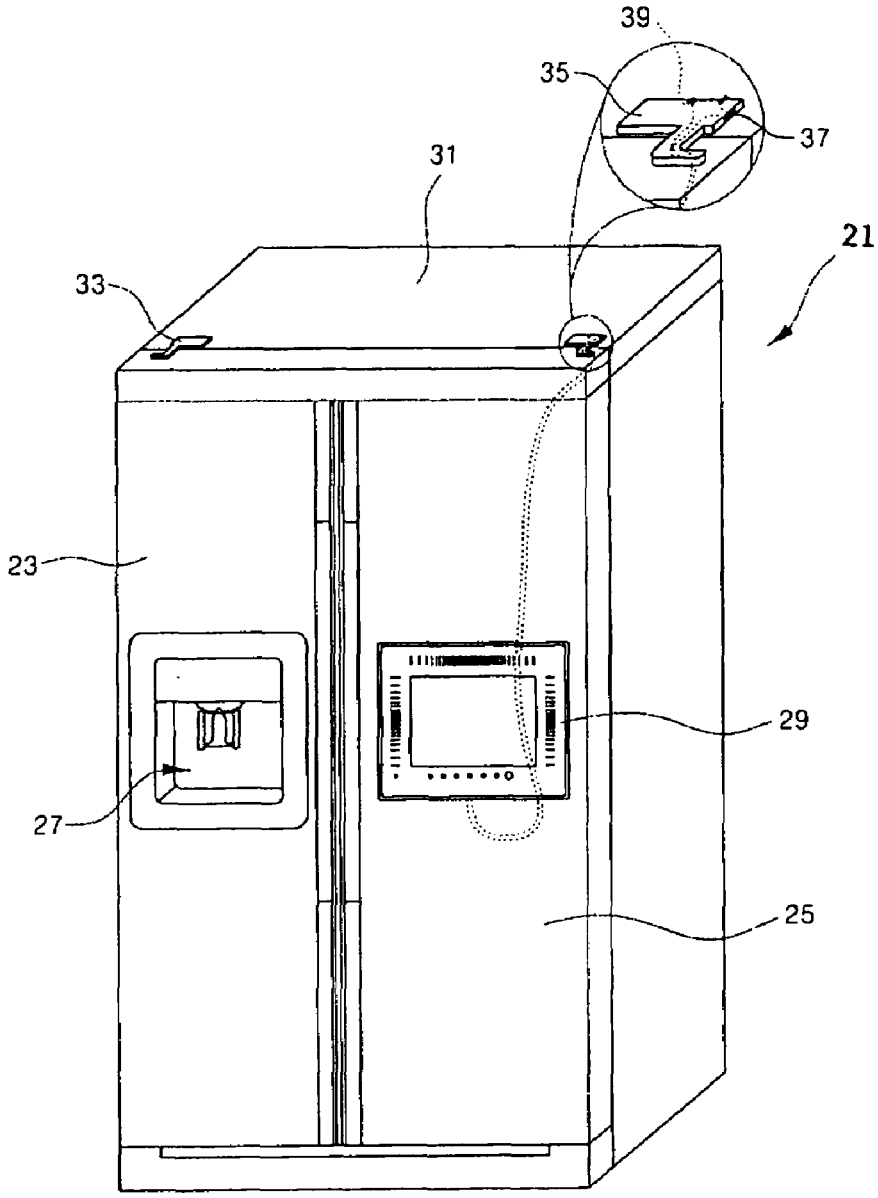
FIG. 2 is a perspective view of a refrigerator equipped with a power switch and connector structure according to a preferred embodiment of the present invention.
Figure 3:
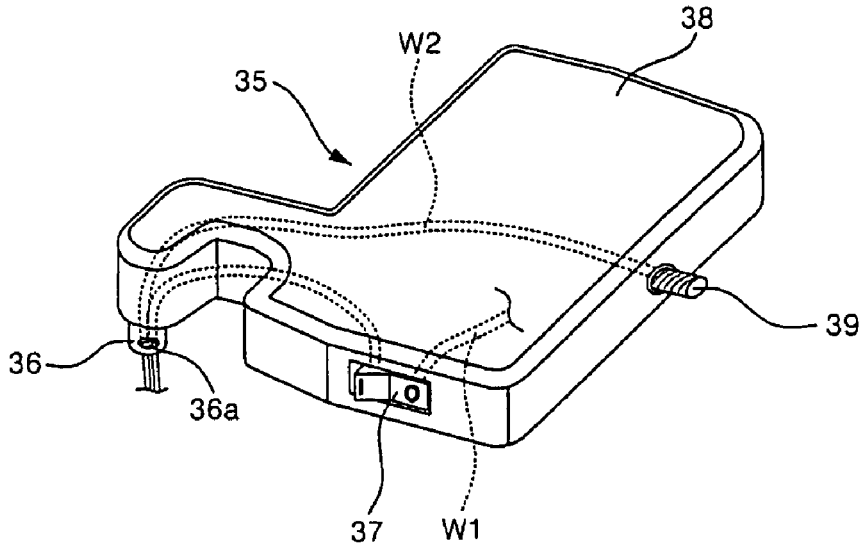
FIG. 3 is a perspective view of a hinge assembly of the embodiment shown FIG. 2.

FIG. 2 shows a preferred embodiment of a power switch and connector structure of an integrated product for a refrigerator according to the present invention, and FIG. 3 shows a hinge assembly of the preferred embodiment shown in FIG. 2. Herein, a description will be made with reference to a case where a display unit capable of performing a TV receiving function or Internet function is provided in the refrigerator as an example of a variety of integrated products that can be provided in the refrigerator.

As shown in the figures, a freezing chamber door 23 and a refrigerating chamber door 25 are installed at a main body 21 of the refrigerator, respectively. The doors 23 and 25 serve to selectively open and close a storage space provided within the main body 21 of the refrigerator and pivotally supported by hinge assemblies 33 and 35 installed at right and left ends of the main body 21 of the refrigerator, respectively. Only upper hinge assemblies 33 and 35 are shown in FIG. 2, but lower hinge assemblies are also installed at lower ends of the doors 23 and 25 corresponding to the right and left ends of the main body 21.

A dispenser 27 capable of dispensing out water or ice in the refrigerator without opening the freezing chamber door 23 is installed at a portion on a front surface of the door 23. A display unit 29 is also installed at a portion on a front surface of the refrigerating chamber door 25. The display unit 29 is installed on the front surface of the refrigerating chamber door 25 such that a user can watch a television broadcast or can use the Internet, if necessary. In such a case, it is apparent that the display unit should be connected to an antenna or cable to watch a television broadcast and be connected to a LAN to use the Internet.

Further, a control unit 31 in which a variety of electrical circuit components for controlling the operations of the refrigerator and display unit are installed is provided on the front surface of the main body 21 of the refrigerator. Performs the control of audio and video signals of the display unit 29 as well as the operating control for the refrigerator. For example, the control unit 31 will perform the function of controlling the audio and video signals of the display unit 29 based on input signals from a variety of buttons installed on the front surface of the display unit 29.

In the meantime, FIG. 3 shows a hinge assembly 35 that can pivotally support an upper end of the refrigerating chamber door 25. The hinge assembly 35 for supporting the refrigerating chamber door 25 with the display unit 29 installed thereon comprises a hinge plate 38 fixed to a right portion on a top surface of the main body of the refrigerator, and a hinge pin 36 extending from the front to the rear of the hinge plate 38.

The hinge pin 36 is inserted into a hinge hole (not shown) provided at a portion on an upper end surface of the door 25 such that the door can be pivotally supported. A through-hole 36*a* through which lead wires W1 and W2 can pass is formed in the hinge pin 36.

Further, a switch 37 is installed at a side of the hinge plate of the hinge assembly 35 according to the present invention. The power switch 37 is to switch on/off power supplied to the display unit 29. The power switch 37 may be installed on any side of the hinge plate 38, but it is preferred that the power switch be installed on a lateral side of the hinge plate 38 corresponding to a lateral side of the main body of the refrigerator in order to prevent the switch from being exposed to the front of the refrigerator. In addition, the power switch 37 is connected to the display unit 29 and control unit 31 by means of the lead wire W1.

According to the present invention, a connector 39 is also installed on a side of the hinge plate 38 of the hinge assembly 35. The connector 39 is connected to an external signal line, e.g. either an antenna line or cable when a user wishes to watch television on the display unit 29 or a LAN cable when the user uses the Internet on the display unit 29. Since the connector 39 should be connected to the external signal line, it is preferred that the connector not be exposed to the outside as viewed from the front of the refrigerator. As shown in the illustrated embodiment, therefore, the connector 39 is preferably installed to protrude rearward from the rear of the hinge plate 38. Further, in a case where the connector 39 is connected to the external signal line, e.g. the antenna line (not shown), it is internally connected to the display unit 29 by means of the lead wire W2.

The aforementioned lead wires W1 and W2 are connected to the power switch 37 and the connector 39, respectively, and also pass through the through-hole 36*a* of the hinge pin 36 of the hinge assembly 35. The lead wires W1 and W2 also pass through the through-hole 36*a* of the hinge pin 36 and are then connected to the display unit 29. In the illustrated embodiment, the lead wires W1 and W2 are connected to a lower end of the display unit 29.

According to the present invention so configured, if a user intends to watch a TV broadcast on the display unit 29 in the kitchen, he/she first turns on the power switch 37 to apply power to the display unit 29. If the power is applied to the display unit 29 through the lead wire W1 under the control of the control unit 31 by turning on the switch 37, audio and video signals are transmitted to the display unit 29 through the connector 39 and the lead wire W2.

The audio and video signals so transmitted are reproduced on the display unit 29 such that the user can watch a TV broadcast. Further, since the power switch 37 and the connector 39 are installed on the hinge assembly 35 by which the refrigerating chamber door 25 can be pivoted on the main body 21 of the refrigerator, they cannot be easily visible from the front of the main body of the refrigerator. Therefore, a front appearance of the refrigerator can be neat and tidy.

As described above, a basic technical spirit of the present invention is that the power switch and connector for the integrated product of the refrigerator are installed at a side of the hinge assembly by which the refrigerator door can be pivotally installed to the main body of the refrigerator.

Although it has been described in the illustrated embodiment of the present invention that the connector is used to transmit radio waves to the display unit, the use thereof is not limited thereto. For example, in a case where a tablet computer is connected to a front surface of the refrigerating chamber door, the connector may be connected to a LAN cable.

The power switch and connector structure for the integrated product of the refrigerator according to the present invention described above in detail has the following advantages.

First, since the power switch and connector for the integrated product of the refrigerator according to the present invention are installed on the hinge assembly by which the refrigerator door can be pivotally installed to the main body of the refrigerator, the front appearance of the refrigerator can be simplified.

Further, since the power switch and connector are arranged at the side or rear of the hinge assembly, they cannot be easily visible from the front of the refrigerator, thereby substantially providing a neat and tidy appearance of the refrigerator.

Furthermore, since power can be prevented from being transmitted to the integrated product installed on the door by merely turning off the power switch if an additional power switch is installed to a hinge assembly, standby power can be accordingly saved on.

It will be apparent to those skilled in the art that other various modifications and changes can be made within the scope of the fundamental technical spirit of the present invention. Therefore, the scope of the present invention should be construed on the basis of the appended claims.

What is claimed is:

1. A switching device for a refrigerator having a main body, and a door configured to receive an integrated product, the switching device comprising:

a hinge assembly that pivotally couples the door to the main body;

a power switch provided at a first side of the hinge assembly, wherein the power switch selectively applies power to an integrated product coupled to the door; and a connector provided at a second side of the hinge assembly wherein the connector transmits external electrical signals to the integrated product coupled to the door.

2. The device as claimed in claim 1, wherein the power switch is provided at a lateral side surface of the hinge assembly, and the connector is provided at a rear surface of the hinge assembly.

3. The device as claimed in claim 1, wherein the integrated product is a display, and the connector is configured to connect the display to a display signal.

4. The device as claimed in claim 1, further comprising a first lead wire that connects the power switch and the integrated product, and a second lead wire that connects the connector and the integrated product, wherein the first and second lead wires each pass through a through-hole formed in a hinge pin of the hinge assembly.

5. The device as claimed in claim 1, wherein the power switch and the connector are not visible from a front of the refrigerator.

6. The device as claimed in claim 4, wherein the connector is configured to connect to at least one of an antenna or a cable so as to receive a television signal, or to a LAN cable configured to provide Internet capability to the integrated product.

7. A switching device for a refrigerator having a main body, and a door configured to receive an integrated product, the switching device comprising:

a hinge assembly that pivotally couples the door and the main body; and a power switch provided at a peripheral surface of the hinge assembly, wherein the power switch selectively applies power to an integrated product coupled to the door.

8. The device as claimed in claim 7, wherein the power switch is provided at a lateral side surface of the hinge assembly such that the power switch is accessible from an exterior of the refrigerator.

9. The device as claimed in claim 7, further comprising a connector provided at a peripheral surface of the hinge assembly, wherein the connector is configured to connect to at least one of an antenna or a cable so as to receive a television signal, or to a LAN cable configured to provide Internet capability to the integrated product coupled to the door.

10. The device as claimed in claim 9, further comprising a first lead wire that connects the power switch and the integrated product, and a second lead wire that connects the connector and the integrated product.

11. A switching device for a refrigerator having a main body, and a door configured to receive an integrated product, the switching device comprising:

a hinge assembly that pivotally couples the door and the main body; and a connector provided at a peripheral surface of the hinge assembly, wherein the connector transmits external electrical signals to an integrated product coupled to the door.

12. The device as claimed in claim 11, further comprising a switch coupled to the hinge assembly wherein the switch selectively applies power to the integrated product coupled to the door.

13. The device as claimed in claim 12, wherein the connector and the switch are not visible from a front of the refrigerator.

14. The device as claimed in claim 12, further comprising a first lead wire that connects the switch and the integrated product, and a second lead wire that connects the connector and the integrated product.

15. The device as claimed in claim 11, wherein the connector extends outward from a rear surface of the hinge assembly, and wherein the connector is configured to connect to at least one of an antenna or a cable so as to receive a television signal, or to a LAN cable configured to provide Internet capability to the integrated product coupled to the door.

* * * * *